US006676465B2

(12) United States Patent
Karvinen

(10) Patent No.: US 6,676,465 B2
(45) Date of Patent: Jan. 13, 2004

(54) LOCKING DEVICE FOR OUTBOARD MOTOR

(76) Inventor: Matti Karvinen, Suunnistajantie 7 F 45, FIN-70200 Kuopio (FI)

( * ) Notice: Subject to any disclaimer, the term of this patent is extended or adjusted under 35 U.S.C. 154(b) by 0 days.

(21) Appl. No.: 10/221,904

(22) PCT Filed: Mar. 16, 2001

(86) PCT No.: PCT/FI01/00267

§ 371 (c)(1),
(2), (4) Date: Oct. 9, 2002

(87) PCT Pub. No.: WO01/69023

PCT Pub. Date: Sep. 20, 2001

(65) Prior Publication Data

US 2003/0096544 A1 May 22, 2003

(30) Foreign Application Priority Data

| | | |
|---|---|---|
| Mar. 16, 2000 | (FI) | 20000609 |
| Jun. 2, 2000 | (FI) | 20001320 |
| Jan. 15, 2001 | (FI) | 20010081 |

(51) Int. Cl.[7] ..... B63H 20/08
(52) U.S. Cl. ..... 440/55; 70/164
(58) Field of Search ..... 440/55, 113; 70/212, 70/232, 230, 58

(56) References Cited

U.S. PATENT DOCUMENTS

| | | | |
|---|---|---|---|
| 3,748,879 | A | 7/1973 | Singer et al. |
| 4,030,324 | A | 6/1977 | Rizio |
| 4,228,983 | A | 10/1980 | Bowman, Jr. |
| 4,658,607 | A | 4/1987 | Muse, Jr et al. |
| 5,469,726 | A | 11/1995 | Rushing et al. |
| 5,960,653 | A | 10/1999 | Dewalch et al. |

*Primary Examiner*—Jesus D. Sotelo
(74) *Attorney, Agent, or Firm*—Smith-Hill and Bedell

(57) ABSTRACT

Subject of the invention is a locking device in which there is a locking part (1; 19) preventing the opening and the releasing of the attaching organs of an outboard motor. Characteristic to the device according to the invention is that there is an attaching part (2; 20) to be attached to the back board of a boat and that to this attaching part a locking part (1; 19) can be attached and locked with a lock (3; 23).

9 Claims, 2 Drawing Sheets

LOCKING DEVICE FOR OUTBOARD MOTOR

Figure 1:
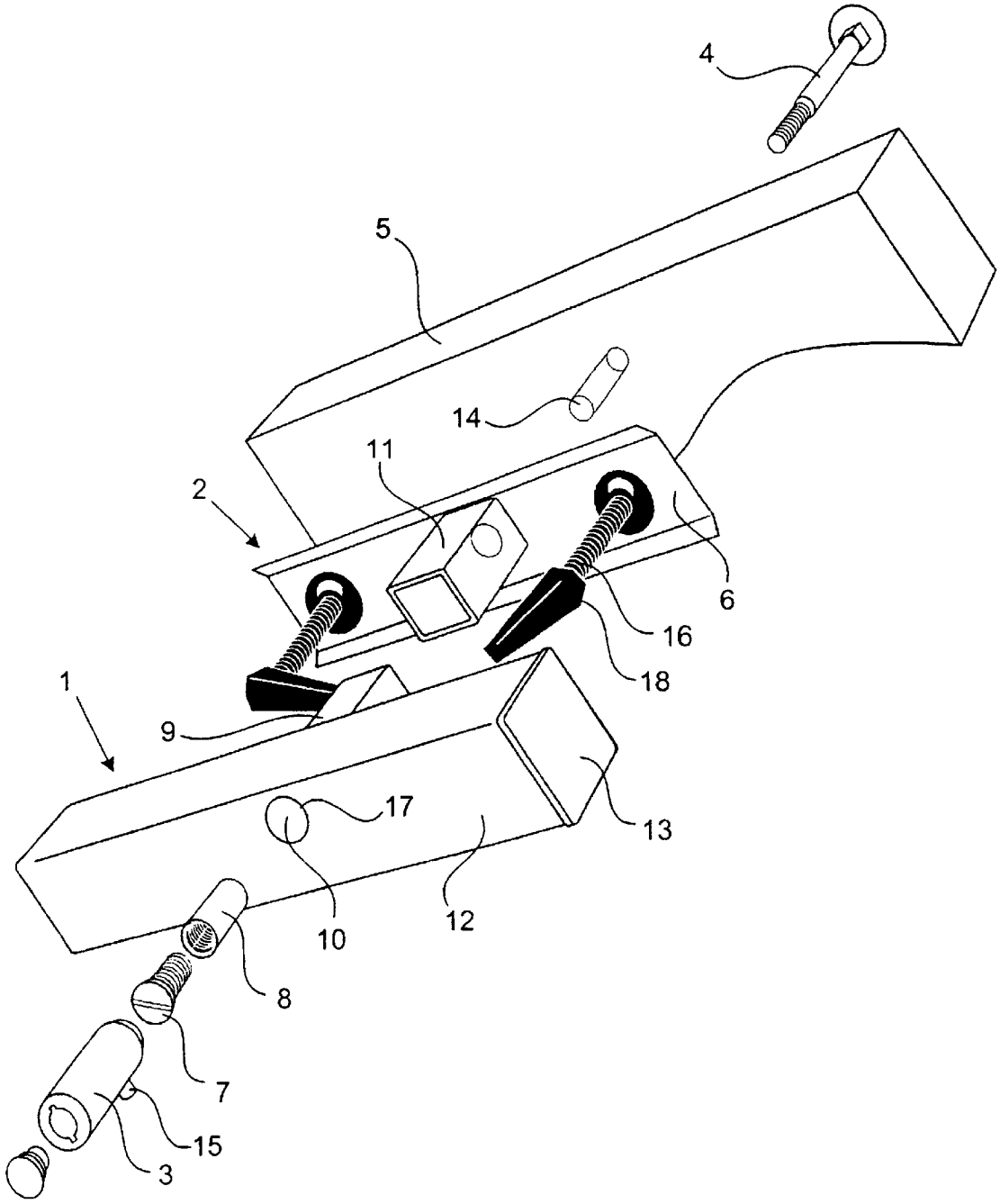

Subject of the invention is a locking device for an outboard motor, which includes a locking part to prevent the opening and the releasing of attaching organs of an outboard motor.

To release an unlocked outboard motor it is enough to open the attaching organs of the outboard motor and release the control cable, the fuel hose and the electric wires. It takes only a few minutes for a thief, equipped with suitable tools to do this. There are some different kinds of locking devices to make it difficult to release an outboard motor unauthorised and to minimise thefts. There is usually a locking part to be attached with a lock to attaching organs of an outboard motor, which covers the turning organs of the attaching organs so that opening of the attaching organs by turning with fingers is not possible. Weakness of a locking device attached like this is, however, the fact that attaching organs of an outboard motor are not constructed to be thief-proof. Therefore releasing a locking part from attaching organs of an outboard motor can be accomplished rather easy and quickly for instance by prying the locking part from attaching organs with a crowbar. Furthermore most of the known locking devices of an outboard motor of today are constructively weak and therefore easy to break by other means.

The purpose of the invention is to create a locking device for an outboard motor, which excludes earlier mentioned problems. The special purpose of the invention is to present a locking device for an outboard motor which is stronger and more difficult to break open with different kinds of breaking tools, like prying, winding or bending with a crowbar than earlier locking devices. Furthermore the purpose of the invention is to present a relatively simple and advantageous locking devise for an outboard motor, which is easy to use, suitable for most models of an outboard motor and has a stylish outlook.

The purpose of the invention is achieved by a locking device for an outboard motor, characteristic of which is what has been presented in the claims.

Characteristic to the locking device according to the invention is the fact that in the locking device there is an attaching part to be fixed to the backboard of a boat, and to this attaching part the locking device is to be attached and locked with a lock. In this way a locking part preventing the opening of attaching organs of an outboard motor can be adjusted on the attaching organs of an outboard motor so that it is much more difficult to break it open. Therefore with this the locking device will be more reliable and stronger than the earlier locking devices and this is more difficult to break with different kinds of breaking tools like crowbars. Furthermore this kind of locking device is relatively simple, advantageous and suitable for most models of an outboard motor.

In an advantageous application of the invention there is at least one attaching organ to attach the attaching part to the backboard of a boat in the locking device. In this way the attaching part can be attached simply and it will be difficult to release it by force from the backboard of a boat. Furthermore in this way the releasing of the attaching part and of the outboard motor that has been attached to it and to the backboard by sliding the outboard motor and its attaching organs upwards is prevented.

In the second advantageous application of the invention there is a supporting component to be attached against the backboard of the boat in the attaching part to prevent the releasing of the attaching part. The supporting component prevents the bending sideways of the attaching part and the cutting of the attaching part and with it the attaching part can be attached against the back board with its attaching organ and with the attaching organs of the outboard motor itself. That is why the supporting component makes it much more difficult to release the attaching part and break the locking device open.

In the third advantageous application of the invention there is at least one attaching organ to be locked with a lock to attach the locking part to the attaching part in the locking device. This is how the locking part can be attached fast and easy to be locked to the attaching part.

In the fourth advantageous application of the invention there is an attaching component connected to the locking part to attach the locking part to the attaching part in the locking part. With the help of the attaching component the locking part can be adjusted with the attaching organs of the outboard motor reliably and strongly and so that it is difficult to break it open. Furthermore inside this kind of an attaching component it is easy to create a lock nest to be closed reliably with many different kinds of locks.

In the fifth advantageous application of the invention there is a lock nest in the locking part to prevent the opening of the attaching organs of the locking part with the lock that can be locked to the lock nest. In this way a lock that is simply and reliable and very difficult to break open has been created to prevent the opening of the attaching organs between the locking part and attaching part.

In the sixth advantageous application of the invention there is at least one covering component in the locking device to cover the attaching organs of the locking part and to prevent their opening. In this way the opening of the attaching organs between the locking part and the attaching part with different kinds tools, like tongs or iron saws is made essentially more difficult relatively simply and reliably.

In the seventh advantageous application of the invention there is a screw organ attached to a nut organ that is attached to the attaching part as an attaching organ. With the help of this kind of an attaching organ the attaching is made strong and it is easy to open after opening the locking device. Furthermore with the help of this kind of an attaching organ the distance between the locking part and the attaching part can be made easy and simply to adjust, and this way the locking device can be suitable for many different kinds of outboard motors with different sizes and with different kinds of attaching organs.

In the eight advantageous application of the invention there is a screw organ attached to the backboard of a boat as an attaching organ of the attaching part. A screw organ is a simple and advantageous attaching organ, with the help of which the attaching part can be attached to the back board of a boat well adapted to its purpose strong and reliably and so that it is difficult to release it by lifting the outboard motor up.

In the ninth advantageous application of the invention there is a pivot lock to be locked to a lock nest as a locking device. A pivot lock is perfectly suitable to lock a lock nest that covers a screw organ. Furthermore it is reliable, small in size and hard to break open when attached to a lock nest In the following the invention is presented more detailed referring to drawings, in which in FIG. 1 there is a perspective figure of a locking device for an outboard motor according to the invention, and in FIG. 2 there is a perspective figure of another locking device for an outboard motor according to the invention.

According to FIG. 1 there is a locking part 1 and an attaching part 2 and attaching organs 4, 7 and 8 of the locking part 1 and the attaching part 2 to be locked with a lock 3 in the locking device of an outboard motor that is to be attached to a back board 5 of a boat. In the locking part there is a frame component 12, in the ends that go to the sides of which there are the head components 13. Besides this there is an attaching component 9 in the locking part 1 and a lock nest 10 inside of the attaching component. In the attaching part 2 there is a supporting part 6 and at the middle point of it where the hole for the screw organ 4 is, there is a covering part 11. There is a nut organ 8 and a screw organ 4 of the attaching part and a screw organ 7 of the locking organ to be attached to the nut organ 8 in the attaching organs of the locking part and the attaching part.

In the application according to FIG. 1 the frame component 12 of the locking part 1 is a square C-profiled pipe component open on the backside. The attaching component 9 is a square component by cross section of suitable length and size and has been attached to the middle point on the frame component on the inner surface of a web plate in the place where the hole 17 is. The attaching component 9 reaches through open space on the back side of the frame component 12 outside it to the attaching part 2 according to FIG. 1. The lock nest 10 created inside the attaching component is by the inner diameter the same size as the outer diameter of the hole 17 in front of the locking part and the lock 3. From the back part of the lock nest to the backside of the attaching component 9 reaches a hole slightly smaller by diameter than the lock nest and similar to the outer diameter of the nut organ by size. In this way there is a shoulder left in the back part of the lock nest and there will the head of the screw organ 7 be locked when it is screwed on the nut organ 8 deep enough. There is a hole in a suitable place in the back part of the lock nest to lock the lock and in this hole there is a pivot organ 15 of the lock 3 to be attached to the lock nest when the lock is locked inside the lock nest 10.

The supporting component 6 of the attaching part 2 is a square component made of plate upper and lower edges of which have been bent diagonally backwards according to FIG. 1. The covering component 11 that covers the screw organ 4 and is supported to the attaching part of the locking part is a pipe component square by cross section and the inner dimensions of which are the same as the outer dimensions of the attaching component 9, and therefore the attaching component 9 can be adjusted inside the covering component 11. The length of the covering component allows the covering component and the attaching component to form a telescopic construction that covers the screw organ 4 despite of the place where the locking part 1 is adjusted according to attaching part 2 by the nut organ 8. Angularity of the attaching component 9 and the covering component 11 prevents the screwing of the locking part according to attaching part and when inside each other the components prevent also the bending of the locking part sideways according to the attaching part.

As an attaching organ of the attaching part there is a screw organ 4, which is a lock cap screw to be placed through the hole 14 on the back board 5 and the attaching part 2 to the nut organ which is located in the back end of the attaching component in the application according to FIG. 1. The nut organ 8 is larger by outer diameter than the hole in the supporting part 6 of the attaching part 2, so that the supporting part 6 can be screwed with the nut, organ 8 against the backboard. Besides the earlier mentioned attaching the supporting part is attached with outboard motor's own attaching organs 16 to the back board 5, and these attaching organs 16 are placed against the supporting part 6 as presented in FIG. 1. There are attaching organs that go through the backboard in some outboard motor models. For those there will be made/there are holes in the supporting part, and with the help of these holes the supporting part is attached to the attaching organs of an outboard motor.

As an attaching organ of the locking part there is a screw organ 7, which is in the application according to FIG. 1 a slotted head screw suitable with the nut organ 8. The locking part 1 is attached against the shoulder in the back part of the lock nest 10 to the nut organ 8 with the screw organ 7. In this way the screw organ 7 presses the frame part 12 of the locking part 1 against the frame part (not shown in the figure) of the attaching organs 16 of the outboard motor and on the turning organ 18, which are part of the attaching organs, and in this way the turning of the attaching organs 16 of an outboard motor is no longer possible. The lock 3 to be attached to the lock nest 10 is a pivot lock to be locked to a hole in the lock nest with the pivot organ 15. The pivot lock that serves as a lock 3 is a known lock by its construction in which there is a pivot organ 15 that moves outside from the inside of the lock frame when the lock is turned to the locking position with a key. As a lock 3 another kind of lock with the help of which the opening of the attaching organ 7 can be functional prevented can also be used.

When an outboard motor equipped with attaching organs which are tightened up with a lock according to FIG. 1 is attached and locked to the back board of a boat first the attaching part 2 is attached with a screw organ 4 and the nut organ 8 to the back board of a boat. After this an outboard motor is adjusted to the backboard of the boat and the attaching organs are tightened up so, that they are placed against the supporting part 6 of the attaching part, on the both sides of the covering part 11. The locking part 1 is placed next on the attaching organs of the outboard motor so, that the turning organs, which are a part of the attaching organs of the outboard motor, stay hidden inside the frame component 12 of the locking part. After this the screw organ 7 of the locking part 1 is adjusted and tightened up to the bottom of the lock nest 10, and this way the locking part is tightened up against the frame part of the attaching organs. Finally lock 3 is pushed to the lock nest 10 and locked to its place with attached key. The locking is opened and the outboard motor is released by doing earlier phases in reverse order.

Figure 2:
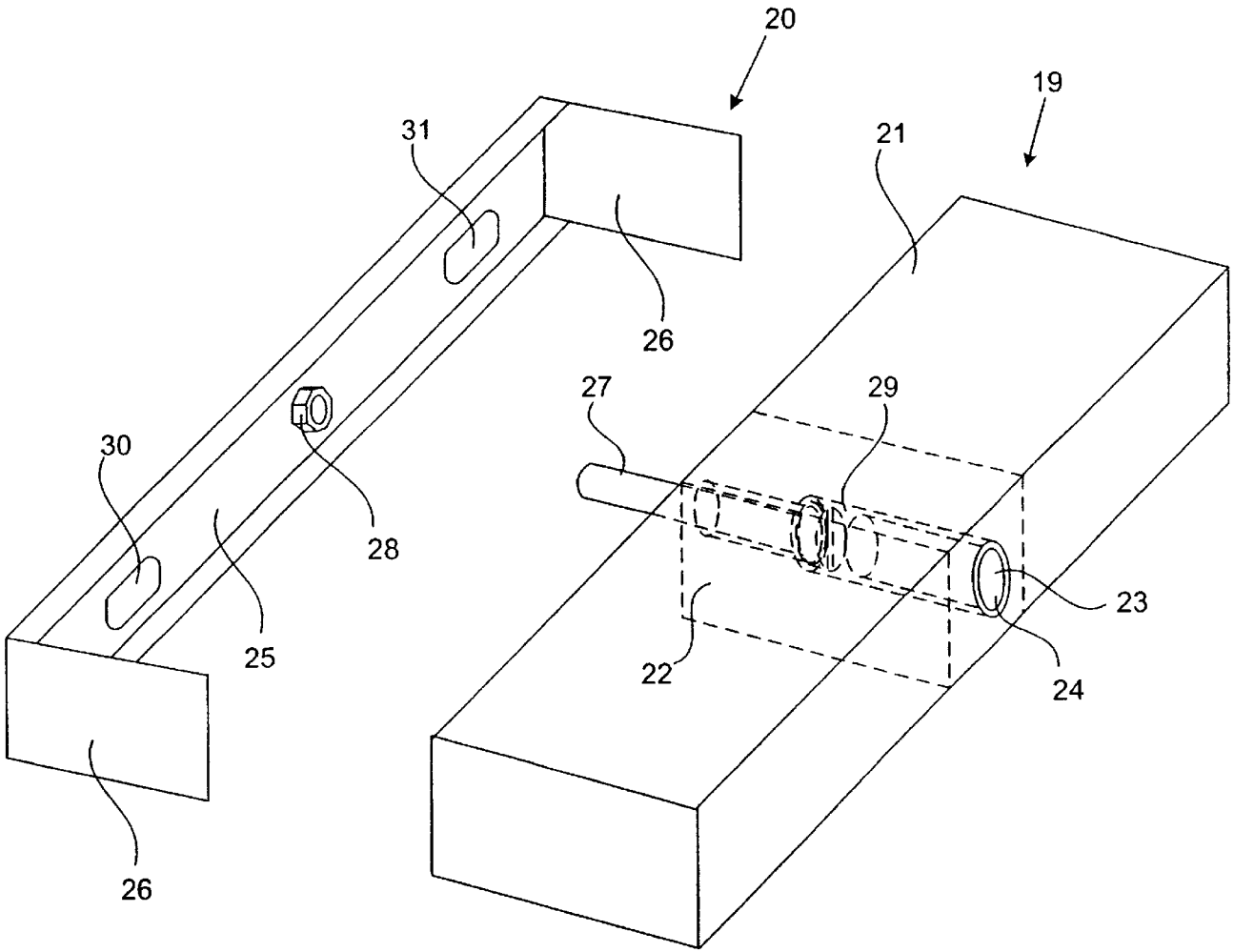

There is another application of the locking device for an outboard motor according to the invention presented in the FIG. 2. In this application the frame component 21 of the locking part 19 is similar by shape to foregoing application but bigger in longitudinal direction of the attaching organs. The attaching component 22 is a square component also similar to the application in FIG. 1 attached at the hole 24 made for the lock 23 on the inner surface of the front plate of the frame component 21. Because of the bigger size of the frame component 21 it stays, however, in its entirety inside the frame component in this application.

Attaching part 20 has been formed from a supporting component 25 and two covering components 26 made of sheet metal in its both ends in the application according to FIG. 2. Their purpose is similar to the purpose of the covering component 11 in the application according to FIG. 1 to prevent the opening of the attaching organ 27 between the locking part 19 and the attaching part 20. In the middle of the supporting component 25 there is a nut organ 28, which is functioning as an attaching organ of the attaching organ 27. There is a screw organ to be attached to the nut organ 28 as an attaching organ 27 of the locking part in this case, which is attached to the shoulder in the bottom of the lock nest 29 inside the attaching component similar to the attaching organ 7 in the application according to FIG. 1. In the application according to FIG. 2 there are holes 30 and 31 on the both ends of the supporting component 25 of the attaching part 20 for the attaching organs of the outboard motor to be attached through the back board. Because of these there are no other attaching organs in the attaching part in this case. However, in another application according to FIG. 2 which is meant for outboard motors equipped with attaching organs to be tightened up to the back board, there is a wooden screw or some other suitable attaching organ to be screwed through a hole bored next to the nut organ to the back board of the boat and with the help of this attaching organ sliding of the attaching part can be prevented.

Locking device for an outboard motor according to the invention can be accomplished also in many other ways as distinct from applications according to FIGS. 1 and 2. In one of the simple applications for a locking device chiefly meant for small outboard motors the attaching part can be just a pipe-type component similar to the covering component 11 in the FIG. 1, which is attached with a screw to the back board of a boat. In that case the frame component of the locking part is smaller in size and the attaching component attached to it can be a pipe component, similar by shape to the attaching part, but the outer dimensions of which are similar to the inner dimensions of the attaching part and which is closed in the back end with a metal sheet with a hole in it. This pipe component is pushed inside the attaching component when locking the outboard motor and attached to the attaching component through a hole in the back end of the attaching component with a screw organ, the opening of which is prevented with a lock like a padlock to be placed in front of the screw organs through holes in the wall of the attaching component. A more complicated application than FIGS. 1 and 2 can be for instance a combination of earlier mentioned, in which there are constructional solutions of different parts of the locking device from all earlier presented applications in the attaching part as the need arises. In this way the locking device according to the invention can be created to be suitable to most models of outboard motors, functional and reasonable by purchase price for different requirements.

The invention is not limited to above presented applications but can vary within the framework of inventional idea according to the claims.

What is claimed is:

1. A locking device for an outboard motor having at least one mounting member for securing the motor to the back board of a boat, the locking device comprising:

an attaching part to be attached to the back board of the boat, a locking part for preventing the opening and releasing of the mounting member of the outboard motor, an attaching element for securing the locking part to the attaching part at a selectively adjustable distance therefrom, a locating structure between the attaching part and the locking part for preventing turning of the locking part and which is made of at least two parts which are mainly rectangular in cross section and which are fitted within each other, and a lock for locking the attaching element.

2. A locking device according to claim 1, comprising at least one attachment element for attaching the attaching part to the back board of the boat.

3. A locking device according to claim 2, wherein the attaching member for attaching the attaching part to the back board of the boat is a screw.

4. A locking device according to claim 1, wherein the attaching part includes a supporting part to be attached against the back board of the boat.

5. A locking device according to claim 1, wherein the attaching structure includes an attaching member connected to the locking part.

6. A locking device according to claim 1, comprising a lock nest in the locking part for receiving the lock and wherein the lock prevents release of the attaching element.

7. A locking device according to claim 6, wherein the lock is a pivot lock to be locked to the lock nest.

8. A locking device according to claim 1, wherein the attaching structure includes a cover component for limiting access to the attaching element.

9. A locking device according to claim 1, wherein the attaching element comprises a screw that is in threaded engagement with a nut in the attaching part.

* * * * *